US010823339B2

(12) United States Patent
Heil et al.

(10) Patent No.: US 10,823,339 B2
(45) Date of Patent: Nov. 3, 2020

(54) ILLUMINANT FOR AN LED LAMP, AND LED LAMP

(71) Applicant: LEDVANCE GmbH, Garching bei Munich (DE)

(72) Inventors: Thomas Heil, Schernfeld (DE); Heinz Lang, Schernfeld (DE); Georg Rosenbauer, Wassertrüingen (DE)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/349,488

(22) PCT Filed: Mar. 6, 2017

(86) PCT No.: PCT/EP2017/055208

§ 371 (c)(1),
(2) Date: May 13, 2019

(87) PCT Pub. No.: WO2018/091149

PCT Pub. Date: May 24, 2018

(65) Prior Publication Data

US 2019/0338891 A1 Nov. 7, 2019

(30) Foreign Application Priority Data

Nov. 18, 2016 (DE) ..... 10 2016 122 228

(51) Int. Cl.

| | |
|---|---|
| ***F21K 9/232*** | (2016.01) |
| ***F21V 29/503*** | (2015.01) |
| ***F21V 29/85*** | (2015.01) |
| ***F21K 9/66*** | (2016.01) |
| ***F21V 3/06*** | (2018.01) |
| ***F21V 23/06*** | (2006.01) |
| *F21Y 115/10* | (2016.01) |

(52) U.S. Cl.

CPC ..... *F21K 9/232* (2016.08); *F21K 9/66* (2016.08); *F21V 3/061* (2018.02); *F21V 23/06* (2013.01); *F21V 29/503* (2015.01); *F21V 29/85* (2015.01); *F21Y 2115/10* (2016.08)

(58) Field of Classification Search

CPC ..... F21K 9/232; F21K 9/66; F21V 29/503; F21V 29/85; F21V 3/061; F21V 23/06; F21Y 2115/10

See application file for complete search history.

(56) References Cited

U.S. PATENT DOCUMENTS 4,015,164 A * 3/1977 Fischer ..... H01J 61/18 313/642
9,958,116 B2 * 5/2018 Cai ..... F21K 9/275
(Continued)

FOREIGN PATENT DOCUMENTS

CN 103511862 A 1/2014
DE 202013009434 U1 12/2013
DE 202013009629 U1 2/2014
(Continued)

*Primary Examiner* — Mary Ellen Bowman
(74) *Attorney, Agent, or Firm* — Hayes Soloway PC

(57) ABSTRACT

A light fixture for an LED lamp having a glass bulb and at least one light-emitting diode. The glass bulb is filled with a heat-conducting gas and the at least one light-emitting diode is arranged inside the glass bulb. The heat-conducting gas in the glass bulb has a pressure of at least 2.2 bar at room temperature.

23 Claims, 10 Drawing Sheets

(56) References Cited

U.S. PATENT DOCUMENTS

| | | | | |
|---|---|---|---|---|
| 2013/0271989 | A1* | 10/2013 | Hussell | F21V 29/004 362/249.02 |
| 2016/0260876 | A1 | 9/2016 | Sun et al. | |

FOREIGN PATENT DOCUMENTS

| | | | |
|---|---|---|---|
| DE | 102014213560 | A1 | 1/2015 |
| EP | 2535640 | A1 | 12/2012 |
| EP | 2827046 | A1 | 1/2015 |
| WO | 2012042428 | A2 | 4/2012 |
| WO | 2016154156 | A1 | 9/2016 |

* cited by examiner

ILLUMINANT FOR AN LED LAMP, AND LED LAMP

CROSS-REFERENCE TO RELATED APPLICATIONS AND PRIORITY

This patent application is a U.S. National Stage of International Patent Application No. PCT/EP2017/055208 filed on Mar. 6, 2017, which claims priority from German Patent Application No. 10 2016 122 228.3 filed on Nov. 18, 2016. Each of these patent applications are herein incorporated by reference in its entirety.

TECHNICAL FIELD

The present invention relates to an LED light fixture as well as an LED lamp with an LED light fixture.

BACKGROUND

Light fixtures of LED lamps, in particular LED retrofit lamps, usually include light-emitting diodes as luminaires as well as a heat-conducting gas for cooling the light-emitting diodes by means of thermal conduction. In this case the heat-conducting gas is provided at a very limited relative pressure. A higher pressure could facilitate an improvement in the heat dissipation since, in addition to thermal conduction, thermal convection also comes into effect. However, the pressure of the heat-conducting gas is sometimes limited by the material and/or the geometry of the glass shell of the LED lamp.

The published document EP 2 535 640 A1 describes an LED lamp.

SUMMARY

Starting from the known prior art, it is an object of the present invention to provide a light fixture with an improved heat dissipation as well as an LED lamp with such a light fixture.

This object is achieved by a light fixture and an LED lamp with the features of the independent claims. Advantageous further embodiments are apparent from the subordinate claims, the description, the drawings and also the exemplary embodiments described in connection with the drawings.

Accordingly, a light fixture for an LED lamp is specified, comprising a glass bulb which is filled with a heat-conducting gas, as well as at least one light-emitting diode arranged inside the glass bulb. The heat-conducting gas in the glass bulb has a pressure of at least 2.2 bars, corresponding to $2.2*10^5$ Pa, at room temperature.

Furthermore, an LED lamp described here comprises a glass shell which is filled with the heat-conducting gas and a light fixture arranged inside the glass shell, preferably the previously described light fixture. The heat-conducting gas in the glass bulb has a pressure of at least 1 bar ($10^5$ Pa), at room temperature.

In this case and in the following, the pressure in the glass shell can be the pressure which prevails in an intermediate space between the glass shell and the glass bulb.

Room temperature is understood to be a temperature of at least 10° C. (283 K) and at most 37° C. (310 K), preferably at least 18° C. (291 K) and at most 25° C. (298 K). The room temperature is particularly preferably the reference temperature of 20° C. (293.15 K).

A heat-conducting gas is understood to be a gas which conducts heat well. In particular, a heat-conducting gas can have a higher thermal conductivity than air. For example, air has a thermal conductivity of 0.0262 W/mK at a temperature of 0° C. and 0.024 W/mK at a temperature of 25° C. At room temperature, in particular at 20° C., a heat-conducting gas can have a thermal conductivity of at least 0.05 W/mK, preferably at least 0.10 W/mK and particularly preferably at least 0.13 W/mK. For example, the heat-conducting gas can include helium or can be helium. Helium can have a thermal conductivity of 0.1567 W/mK at a temperature of 0° C. and 0.142 W/mK at a temperature of 25° C. The heat-conducting gas can also include hydrogen or can be hydrogen. Hydrogen gas can have a thermal conductivity of 0.186 W/mK at a temperature of 0° C. and 0.168 W/mK at a temperature of 25° C. Other gases or gas mixtures which have a higher thermal conductivity relative to air are likewise conceivable.

The LED lamp preferably comprises a light fixture described here. That is to say, all features described for the light fixture are also described for the LED lamp, and vice versa. The LED lamp can be, for example, an LED retrofit lamp or an LED light.

The use of a high pressure of the heat-conducting gas enables an improved heat dissipation from the light-emitting diode in the glass shell. In particular, a higher pressure of the heat-conducting gas can lead to an increased convection inside the glass bulb. For example, the pressure is at least 3 bars ($3*10^5$ Pa), preferably at least 4.5 bars ($4.5*10^5$ Pa). The pressure is at most 10 bars ($10^6$), preferably at most 6.5 bars ($6.5*10^5$ Pa). The pressure is in particular the absolute pressure inside the glass bulb. A higher pressure can be provided, in particular, by the use of a separate glass bulb, which can be provided for positioning in the glass shell of the LED lamp.

The glass bulb is preferably designed to be transparent to radiation. In this case and in the following, an element can be designed to be "transparent to radiation" if it has a transmissivity of at least 60%, preferably at least 70% and particularly preferably at least 80%, for the radiation emitted by the light-emitting diode. It has been shown that a possible loss of emitted light output due to absorption on the glass bulb can be compensated for by the improved heat dissipation.

The glass bulb is preferably vacuum sealed. In other words, the glass bulb can be closed and/or fused in such a way that the absolute pressure inside the glass bulb is maintained without external devices, such as pumps. Thus the glass bulb can enclose a sealed or self-contained volume. In particular, the glass bulb can be designed to be gas-tight.

The pressure of the heat-conducting gas inside the glass shell is preferably lower than the pressure of the heat-conducting gas inside the glass bulb. For example, the pressure in the glass shell is at least 0.5 bar ($0.5*10^6$ Pa), preferably at least 1 bar ($10^5$ Pa) lower than in the glass bulb. The pressure in the glass shell is preferably 1 bar ($10^5$ Pa).

According to at least one embodiment of the light fixture, the glass bulb contains a getter material. The getter material preferably serves for setting (so-called "degettering") of volatile organic compounds (VOC) and/or volatile compounds containing sulfur, phosphorus and/or chlorine. The getter material can be introduced into the glass bulb in the solid and/or gaseous state. The volatile organic compounds and/or compounds containing sulfur, phosphorus and/or chlorine can also be generally designated below as "volatile compounds".

In closed glass bulbs in the case of light fixtures with light emitting diodes the problem of gaseous emissions of volatile organic compounds can increasingly occur. To some extent this is due to the fact that the glass bulb of the light fixture is designed to be smaller than for example the glass shell of the LED lamp because of the higher mechanical loading by the high pressure. Similarly to the technology of the halogen lamp, in which due to the smaller bulb any evaporating tungsten compounds can be degettered by halogen compounds, degettering of volatile organic compounds and/or volatile compounds containing sulfur, phosphorus and/or chlorine can also occur in small closed glass bulbs for light fixtures with light emitting diodes.

The volatile organic compounds or the volatile compounds containing sulfur, phosphorus and/or chlorine can originate, for example, from fluxing agent residues or solder resists from soldering processes. Furthermore, the volatile compounds can be gaseous emissions of polymers of the light emitting diode, glues and/or heat conducting pastes. Moreover, volatile compounds can originate from a circuit board, in particular a metal core circuit board, to which the at least one light-emitting diode can be fastened. For example, the volatile compounds originate partially from a printed circuit board core material of a circuit board. In particular, the volatile organic compounds can include oxygen, nitrogen, hydrogen and/or carbon.

Volatile organic compounds present in the glass bulb can be deposited on the material of the glass bulb where they lead to discolorations. This is known under the term "fogging" of the glass bulb and can lead to losses of luminous flux of up to 10%. The diffusion of the volatile organic compounds into a silicone shell which may be present on the light emitting diode is even more serious. As a result, hydrocarbon compounds in the silicone shell are broken up and the silicone can take on a dark color. This can lead to losses of luminous flux of over 50%. This loss of luminous flux is most of the time associated with an additional color location shift. These two phenomena are known under the terms "lumen degradation" and "change color chromaticity". Furthermore, compounds containing sulfur, phosphorus and/or chlorine can lead to reflection losses on a silver mirror which may be present below the emitting layers of the light emitting diode.

The getter material is preferably introduced at least partially as gas into the glass bulb. The gaseous getter material is, for example, hydrogen-rich and/or oxygen-rich compounds, which preferably bind volatile carbon-containing compounds and, for example, react to $CH_4$ or $CO/CO_2$. Due to the binding a reaction with a silicone shell and/or a deposition on the glass bulb can be prevented. In particular, the getter material can contain oxygen gas and/or a silane, for example a monosilane ($SiH_4$). In this case because of the high pressure inside the gas bulb it may be possible to introduce the silane at a maximum concentration below an ignition limit or explosion limit. For example, the bulb can be filled with 8% by volume of silane. In particular, the quantity of gaseous getter material can be increased in direct proportion to the pressure of the heat-conducting gas in the glass bulb.

Alternatively or in addition, the getter material can be introduced at least partially into the glass bulb as solid material. As solid getter material, for example, a pure metal is suitable, such as zirconium Zr, tantalum Ta, titanium Ti, palladium Pd, vanadium V, aluminum Al, copper Cu, silver Ag, magnesium Mg, nickel Ni, iron Fe, calcium Ca, strontium Sr and barium Ba, or also alloys of pure metals, such as for example ZrAl, ZrTi, ZrFe, ZrNi, ZrPd and/or $BaAl_4$, are suitable, for example as solid getter material. In this case the use of a ZrAl alloy is preferred. Furthermore, oxides and hydrides of pure metals are suitable as getter material. Metal hydroxides, such as for example magnesium hydroxide or aluminum hydroxide, may be considered in particular as solid getter materials inside the glass bulb. Metal hydroxides are suitable, for example, for degettering of volatile carbon compounds in the closed volume of the glass bulb.

Solid getter materials are preferably applied so that they have a large reactive surface, such as for example as a coating and/or as sintering material. Alternatively or in addition, the getter material can be introduced into the glass bulb as massive metal, for example in wire form.

In this case it is possible that solid getter materials are optimized with regard to their getter behavior by additionally introduced gaseous getters. For example, the getter materials can be activated after a pumping operation and firing in the furnace (tempering). As a result, for example, reactive oxides of metallic getter materials can form.

The glass bulb is preferably formed with quartz glass and/or tempered glass or consists of at least one of these materials. In this case and in what follows, the term "consists" should be interpreted within the context of production tolerances; that is to say, the glass bulb can have impurities due to manufacturing tolerances. For example, the glass bulb contains at least 99% silicon dioxide. By the use of quartz glass or tempered glass a glass bulb can be provided which can be filled with a gas pressure of up to 30 bars ($30*10^5$ Pa). Furthermore, quartz glass and/or tempered glass have the advantage that they are extremely temperature-resistant and, moreover, have very good optical characteristics. Duran glass, aluminosilicate glass and/or borosilicate glass may be considered as tempered glasses. In particular, those glasses which are also used in the construction of halogen lamps are suitable as tempered glasses. The glass bulb can be constructed in the manner of a glass bulb of a halogen lamp. The outer glass shell of the LED lamp preferably contains a soft glass which in particular is not filled with high gas pressures (up to a maximum of approximately 1 bar). Moreover, in that case of the said glasses a temperature shock of 100 K can already lead to rupture or cracking of the glass. In contrast to this, quartz glass and also tempered glass can be exposed to higher temperature shocks, for example up to 1000 K, without ruptures or cracks occurring.

The glass shell of the LED lamp is preferably formed with or made from a soft glass, in particular soda-lime glass. Soft glass is characterized by its low production costs and easy workability.

According to at least one embodiment, the glass bulb is formed with matte glass or consists of matte glass. In particular, the glass bulb can be formed with matte quartz glass and/or matte tempered glass. Matting of the glass bulb leads to a frosted glass effect. For example, due to the matting the appearance of the light fixture is improved, since light-emitting diodes arranged in the glass bulb and optionally electronic components which are for example part of a driver electronics are no longer directly discernible or no longer visible from the exterior due to the matting. Furthermore, an omnidirectional light distribution can be improved by the use of matting. Additionally, the optical transmission angle can be increased by the matting, which leads to a better light distribution.

According to a preferred embodiment of the light fixture, the heat-conducting gas contains helium or consists of helium within the scope of production tolerances. The heat-conducting gas can for example contain a mixture of hydrogen gas and helium gas. Helium is characterized by its good heat conductivity properties.

According to at least one embodiment, the light fixture comprises a circuit board on which the at least one light-emitting diode, preferably a plurality of light-emitting diodes, is arranged. The light-emitting diode can comprise at least one light-emitting diode chip. The circuit board is arranged together with the at least one light-emitting diode inside the glass bulb. The circuit board can be a metal core circuit board, and/or a printed circuit board. Alternatively, it is possible that the circuit board is a thin support, for example an aluminum foil. For example, the circuit board is designed to be reflecting. In this case and in the following, an element can be designed to be "reflecting" if it has a degree of reflection of at least 60%, preferably at least 70% and particularly preferably at least 80%, for the radiation emitted by the light-emitting diode.

Preferably this circuit board and/or the printed circuit board can be equipped double-sided or on both sides. As a result, an emission in different spatial directions, in particular forwards and rearwards, can be made possible so that a more uniform illumination can be achieved. In this case and in the following, equipping on both sides or double-sided equipping can occur if both a front face and also a rear face of the circuit board or of the printed circuit board has light-emitting diode chips and optionally electronic components.

For the provision of a circuit board or printed circuit board equipped on both sides, two circuit boards or two printed circuit boards can each be equipped on one side (that is to say only on their respective front faces or on their respective rear faces) and can then be connected on their exposed surfaces which are not equipped. The connection takes place for example using an adhesive connecting means, such as for example an adhesive or a cement. A suitable adhesive and/or cement for the bonding is for example a so-called getter cement, which is configured for degettering of volatile compounds. The two connected circuit boards or printed circuit boards can then be electrically conductively connected to one another, for example by means of a bonding wire connection or using a printing process, preferably a plasma or inkjet printing process. Alternatively or in addition, it is possible that a flexible circuit board is bent by 180° around a metal core in order to obtain an emission to the front and to the rear.

Alternatively or in addition, it is possible that the light-emitting diode contains at least one light-emitting diode chip arranged on a printed circuit board and/or a substrate. The light-emitting diode chip can be mounted in particular directly on the printed circuit board and/or the substrate (so-called chip-on-board light-emitting diode). The substrate can contain glass, such as for example quartz glass ($SiO_2$), and/or sapphire ($Al_2O_3$) or can be made from one of these materials.

The light-emitting diode can additionally contain a driver electronics for electrical activation of the at least one light-emitting diode chip. The driver electronics can contain electronic components such as for example rectifiers, current limiters, resistors, capacitors, transistors and/or integrated circuits. The driver electronics is preferably configured to reduce flickering of the light-emitting diode, in particular at a frequency of 100 Hz. In this way it is possible for example to meet the standard DIN EN 12464-1, according to which flickering, in particular at lower frequencies which can be resolved by the human eye, should be reduced.

The light-emitting diode chip and the optionally provided electronic components of the driver electronics can be electrically connected to one another in each case by means of conductive tracks of the circuit board or of the printed circuit board. The conductive tracks can be applied by means of a printing process to the circuit board, the printed circuit board or optionally to the substrate. A suitable printing process is for example a 3D printing process and/or a screen printing process. In the case of a ceramic or glass substrate, a plasma or inkjet process is preferably used. Alternatively or in addition, the light-emitting diode chips and the optionally provided electronic components of the driver electronics can be electrically connected to one another in each case by means of bonding wires.

The light-emitting diode chips, the driver electronics and the conductive tracks can be embedded together in an encapsulation, for example an encapsulation with a conversion material. For example, the driver electronics contains an electronic rectifier, by means of which an alternating current voltage, in particular power supply voltage of 230 V AC, can be converted into smoothed direct current. The electronic rectifier can for example contain at least one bridge rectifier and/or at least one current limiter, for example a resistor. Furthermore, the electronic rectifier can have additional electronic components. Moreover, for a direct electrical connection to a 230 V AC power supply voltage, the light-emitting diode chips can be connected to one another in series.

Alternatively or in addition, it is possible for the light fixture to comprise a driver electronics which is arranged separately from the light-emitting diode. The driver electronics can then, for example, be embedded separately in an encapsulation, in particular a silicone encapsulation. In this way a gaseous emission of volatile, in particular organic, compounds can be prevented by the driver electronics.

According to at least one embodiment the light fixture comprises m circuit boards, wherein $m \geq 2$, preferably $m \geq 3$. Thus the light fixture comprises a plurality of circuit boards. At least one light-emitting diode, preferably a plurality of light-emitting diodes, is arranged on each circuit board. In particular in the case $m \geq 3$, the circuit boards can be arranged on the (imaginary) lateral surfaces of a straight prism with a symmetrical or equilateral base surface with m sides. A symmetrical or equilateral m-sided base surface can have an m-fold axis of rotation. Due to the described arrangement of the circuit boards a large solid angle can covered with the light-emitting diodes. Moreover, due to the arrangement on imaginary lateral surfaces of a prism a cavity enclosed by the circuit boards is produced, which improves heat dissipation from the light-emitting diodes by convection in the cavity. In this case it is possible that the m lateral surfaces are formed from one single circuit board which has been bent a number of times. The circuit board can be flexibly constructed for this purpose.

For another example, the light fixture comprises five circuit boards. In this case the circuit boards are arranged on the lateral surfaces of a straight prism with a pentagonal base surface. The circuit boards then enclose an angle of 108° within the scope of the production tolerances.

According to at least one embodiment of the light fixture, the at least one light-emitting diode is a volume emitter. A volume emitter is characterized in particular in that the light-emitting diode emits in all spatial directions. In other words, a volume emitter emits in the entire 47 solid angle. In contrast to a surface emitter, a volume emitter can have an emission characteristic which is different from a Lambertian emission characteristic. A volume-emitting light-emitting diode can comprise a semiconductor layer sequence grown onto a substrate which is transparent to radiation, such as for example a sapphire substrate or a glass substrate, wherein, after the growing on, the substrate according to the growth is not completely removed from the semiconductor layer. A volume-emitting light-emitting diode can be for example a chip-on-board light-emitting diode.

According to at least one embodiment of the light fixture, the at least one light-emitting diode is at least partially embedded in a conversion material, in particular a wavelength conversion material. The light fixture preferably contains a plurality of light emitting diodes which are all embedded in the conversion material.

By means of a wavelength conversion material the radiation emitted by the light-emitting diode can be converted into radiation of another, preferably higher, wavelength. For example, the light-emitting diode emits blue light which is converted by means of the conversion material into white light.

The conversion material can be introduced in the form of diffuser particles into an encapsulation. The encapsulation can be for example a silicone encapsulation, a polyurethane encapsulation and/or an epoxy resin encapsulation. The encapsulation can be configured in order to protect the at least one light-emitting diode against external influences. Furthermore, the encapsulation can contain further diffuser particles on which a part of the radiation emitted by the light-emitting diode is scattered without a wavelength conversion. Alternatively or in addition, the conversion material can be applied as an in particular ceramic fluorescent layer to a light exit surface of the light-emitting diodes.

According to at least one embodiment of the light fixture, this light fixture comprises at least one electrical connector. The electric connector serves for electrically contacting the at least one light-emitting diode. The electrical connector passes through the glass bulb. In other words, the electrical connector extends from an interior of the glass bulb through the glass bulb to the exterior. An outer connection region of the electrical connector can be freely accessible and/or electrically contactable from the exterior. The connector can be in electrical contact with the light-emitting diode. For example, the at least one light-emitting diode, preferably the plurality of light-emitting diodes, has an electrical contact region. The connector can then be connected by a soldered connection to the contact region.

It is possible for the light fixture to be fitted to the at least one connector. For example, the connector can form a plug of a plug connection. The light fixture can then be inserted into a holder. The at least one connector can be part of a so-called pin base. For example, the light fixture contains two connectors which form a G4 and/or G9 pin base. In particular, in the case of a G4 and/or G9 pin base, it is possible for the light-emitting diode of the light fixture to be constructed as a chip-on-board light-emitting diode. The light-emitting diode chips of the light-emitting diode can then be applied directly to a printed circuit board and/or a substrate. Furthermore, the light-emitting diode chips can be encapsulated together with the driver electronics and any conductive tracks in an encapsulation. The encapsulation can be for example a silicone encapsulation with a conversion material introduced therein.

The connector can be fused or welded to the glass bulb. The fusion can take place, in particular, in such a way that the glass bulb is vacuum sealed. For example, a molybdenum film and/or a molybdenum wire is attached between the glass bulb and the at least one connector, in particular in a fusion region of the connector, in order to simplify the fusion. The molybdenum film or the molybdenum wire is formed with molybdenum or consists of molybdenum. Furthermore, the molybdenum film or the molybdenum wire can contain a getter material, for example in the form of a coating. In the case of a quartz glass bulb a molybdenum film is preferably used and in the case of a tempered glass bulb a molybdenum wire is preferred. Furthermore, transition glasses can be attached between the glass bulb and the connector. Moreover, it is possible that the connector and/or any retaining wires provided for a circuit board consist of a getter material or are coated with a getter material. The above-mentioned solid getter materials are, for example, suitable for this purpose.

According to at least one embodiment, the light fixture further comprises a glass support on which the at least one light-emitting diode is arranged. The light-emitting diode is arranged, in particular, between the glass support and the glass bulb. In other words, a side of the light-emitting diode remote from the glass support is facing the glass bulb, and vice versa. The glass support can be for example an inner bulb of the glass bulb. The glass support is preferably designed to be transparent to radiation.

According to at least one embodiment, the glass support has the shape of a tube. Thus, the glass support can have an outer lateral surface and an inner lateral surface. The at least one light-emitting diode is then arranged on the outer lateral surface of the glass support. In particular, the glass support has the shape of a cylindrical tube, wherein the interior of the glass support is hollow. The glass support can be open on its end faces. As a result, the interior of the glass support can likewise be filled with the heat-conducting gas. As a result, an additional convection inside the glass support is facilitated and thus the cooling of the light-emitting diode is improved. Alternatively or additionally, the glass bulb can be constructed as a cylinder. However, it is also possible that the glass bulb has an ellipsoidal or spherical construction.

The light-emitting diode can be arranged on the glass support in such a way that a side surface of the light-emitting diode is covered and/or overlapped by the glass support. The lateral surface can be a mounting surface of the light-emitting diode.

According to at least one embodiment, the light fixture comprises a plurality of light-emitting diodes which are arranged inside the glass bulb. The light-emitting diodes form an LED filament. The light fixture can in particular comprise a plurality of LED filaments. An LED filament (also referred to as LED fluorescent colors) can be a wire-like component which contains a plurality of light-emitting diodes which are in particular series-connected. Furthermore, an LED filament can contain a fluorescent layer. With an LED filament as luminaire, it is possible, for example, to simulate the appearance of a glow wire of a conventional incandescent bulb. If the light fixture has a plurality of LED filaments, these can be electrically interconnected. For example, the LED filaments are then connected in series.

According to at least one embodiment of the light fixture, this light fixture comprises a plurality of LED filaments. The LED filaments are arranged regularly spaced apart on the outer lateral surface of the glass support. A main extension direction of each LED filament extends along the extension direction of the glass support. In this case an extension direction of the glass support extends, in particular, along the outer lateral surface from one end face to the other end face of the glass support. In this connection and in the following, a number n of LED filaments, with $n \geq 2$, can then be arranged "regularly spaced apart" on the lateral surface when the glass support with the LED filaments an n-fold axis of rotation axis along the extension direction of the glass support.

BRIEF DESCRIPTION OF THE DRAWINGS

Preferred further embodiments of the invention are explained in greater detail by the following description of the drawings. In the drawings.

DETAILED DESCRIPTION OF THE DRAWINGS

Figure 1A:
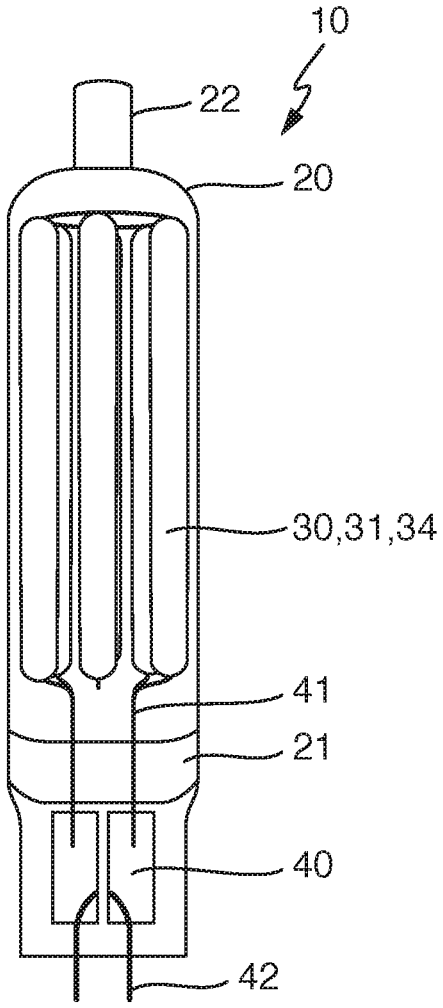
FIGS. 1A, 1B, 2A, 2B, 3A, 3B, 4, 5, 6, 7, 8, 9A, 9B, 10A, 10B, 11A, 11B, 12A, 12B, 13A, 13B, 14A, 14B and 14C show exemplary embodiments of a light fixture described here as well as an LED lamp described here.

The light fixture described here as well as the LED lamp described here are explained in greater detail below with reference to exemplary embodiments and the associated drawings. In this case elements which are the same, of the same kind, similar or equivalent are provided with the same reference numerals. Repeated description of some of these elements is omitted in order to avoid redundancies.

The drawings and the size ratios of the elements illustrated in the drawings should not be regarded as drawn to scale relative to one another. On the contrary, individual elements may be shown as excessively large for better illustration and/or to aid understanding.

Figure 1B:
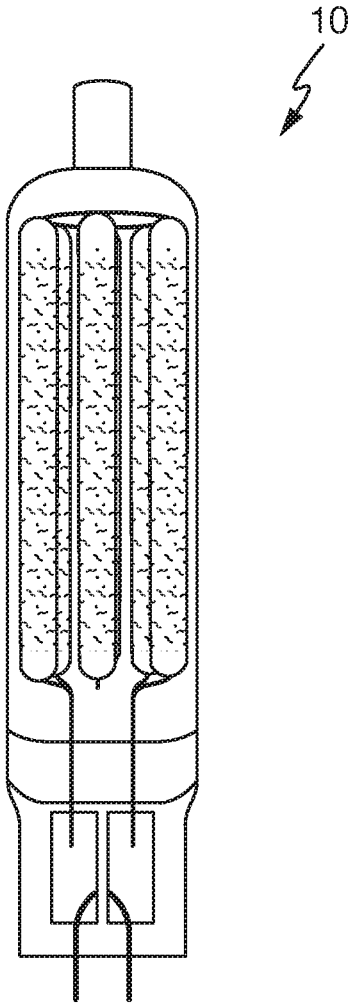

An exemplary embodiment of a light fixture 10 described here is explained in greater detail with reference to the illustrations in FIGS. 1A and 1B. FIG. 1A shows an illustration of the light fixture 10 in the switched-off state, while FIG. 1B shows an illustration in the switched-on state, that is to say with luminous light-emitting diodes 31.

The light fixture 10 comprises a glass bulb 20 with an extension 22 and a mounting region 21. Furthermore, the light fixture 10 comprises LED filaments 30 with light-emitting diodes 31 and in each case a conversion material 34 which surrounds the light-emitting diode 31 as encapsulation, as well as connectors with a fusion region 40, an inner connection region 41 and an outer connection region 42.

In the illustrated exemplary embodiment, the glass bulb 20 is designed to be cylindrical. The glass bulb 20 is vacuum sealed and is filled with a heat-conducting gas, such as for example helium. The glass bulb 20 can be formed with quartz glass and/or tempered glass or can be made therefrom.

For example, the glass bulb 20 is produced using a glass-blowing technology and/or by means of extrusion. In this case it is possible that first of all a long, tubular glass piece is provided. The glass piece can then be subdivided into several components, wherein a glass bulb 20 can be formed from each component. The extension 22 can be formed at a separation region between the components, for example by thinning of the glass in the separation region. The mounting region 21 can be constructed on a side opposite the extension 22. In the mounting region 21, a vacuum seal can be provided for example by pressing together or crimping the end regions of the component from the glass piece. Before the pressing together the light-emitting diode 31 can be placed in the interior of the component and the interior can be filled with the heat-conducting gas.

The LED filaments 30 are uniformly distributed in the glass bulb 20 and extend along a main extension direction of the cylindrical glass bulb 20. Furthermore, the LED filaments 30 extend along a glass support 25 which cannot be seen in FIGS. 1A and 1B and is arranged in the interior of the glass bulb 20.

The mounting region 21 can serve for holding and electrical contacting of the light fixture 10. The mounting region 21 is in particular constructed in such a way that the interior of the glass bulb 20 is vacuum sealed and the heat-conducting gas contained in the glass bulb 20 cannot escape from the glass bulb 20.

The light-emitting diodes 31 can be contacted by means of the connectors. For this purpose, for example, the outer connection region 42 can be inserted in a holder of an LED lamp 100. The inner connection region 41 can be connected to a contact region 35 of the light-emitting diodes 31.

Further exemplary embodiments of a light fixture 10 of a LED lamp 100 described here are explained in greater detail with reference to the illustrations in FIGS. 2A and 2B. The light fixture 10 of FIGS. 2A and 2B again contains a glass bulb 20. In contrast to the exemplary embodiment of FIGS. 1A and 1B, a circuit board 32 to which light-emitting diodes 31 are attached is arranged in the glass bulb. Moreover, the glass bulb 20 has no additional glass support 25. The light-emitting diodes 31 can be, for example, soldered onto the circuit board 32. A conversion material 34, present for example as a fluorescent layer, can be mounted in each case on the light-emitting diodes 31. Alternatively or in addition, an encapsulation 34, for example in the form of a conversion encapsulation 34, can be mounted on the light-emitting diode 31. It is possible that the glass bulb 20 exclusively contains the first connection region 31 and the circuit board 32 with the light-emitting diodes 31.

Figure 2A:
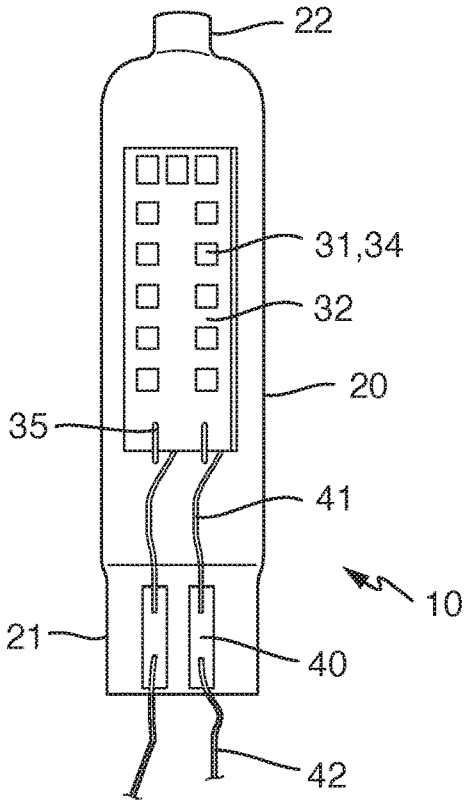
Figure 2B:
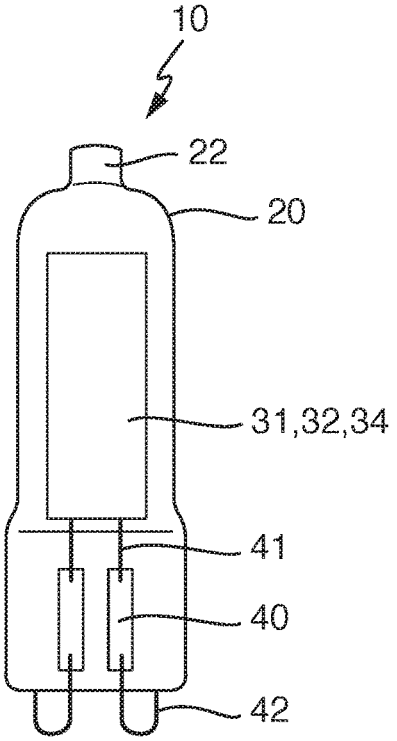

In particular, a flat so-called chip-on-board (COB) component is used in the light fixture 10 of FIG. 2B. The light-emitting diodes 31 of the light fixture 10 on a circuit board 32 can be introduced into a conversion material 34. The light-emitting diodes 31 can be attached to the circuit board 32 on both sides or alternatively only on one side. The circuit board 32 can be formed with a material which is partially transparent to radiation (that is to say translucent), such as for example $Al_2O_3$, and/or from a material which is completely transparent to radiation, such as for example (quartz) glass, or is made from such a material. As a result, in particular in the case of a circuit board 32 equipped on one side, the generated light can be guided onto the other side of the circuit board 32.

The light fixture 10 can additionally contain electronic components, which can be part of a driver electronics, (not visible in FIGS. 2A and 2B). For example, these components can contain a rectifier, by which the series-connected light-emitting diodes 31 are operated at 230 V with a rectified frequency of 100 Hz. In order to avoid gaseous emissions of volatile compounds from the electronic component of the light fixture 11, the gas emission rate of the electronic components should be below a gas emission rate of an encapsulation material surrounding the light-emitting diodes 31, in the ideal case even below the gas emission rate of the conversion material 34.

A further exemplary embodiment of a light fixture 10 of a LED lamp 100 described here is explained in greater detail with reference to the illustrations in FIGS. 3A and 3B. The light fixture 10 comprises in each case a circuit board 32 with light-emitting diodes 31 which is introduced into the glass bulb 20, wherein the light-emitting diodes 31 including the circuit board 32 are embedded in a conversion material 34. The outer connection region 42 of the connectors of the light-emitting diodes 31 is embedded in a first housing 26. The first housing 26 can be formed, for example, with a plastic material and can be designed to be electrically insulating. For example, the outer connection region 42 is mechanically and/or electrically protected by the first housing 26. Furthermore, a second housing 27 can be present which can surround the fusion region 40 of the connectors.

Figure 3A:
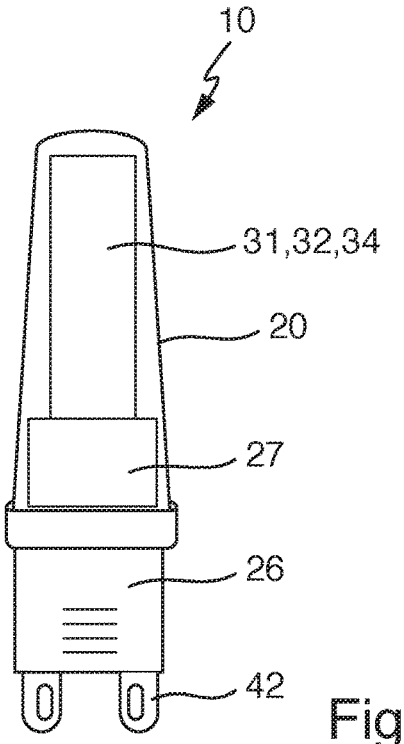
Figure 3B:
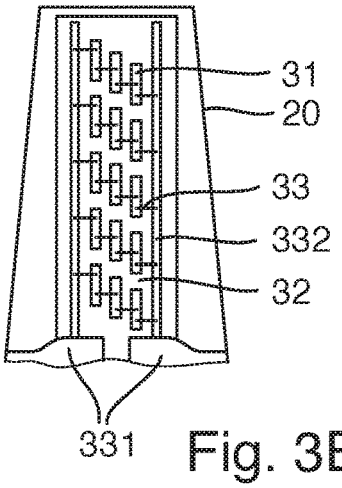

A possible wiring of the light-emitting diodes 31 of the light fixture 11 of FIG. 3A to one another is illustrated in FIG. 3B. The light-emitting diodes 31 are attached to a circuit board 32, which can also be a printed circuit board. In each case a group of light-emitting diodes 31 is series-connected to wirings 33, for example in the form of bonding wires and/or conductive tracks. Purely by way of example, in FIG. 3B in each case three light-emitting diodes 31 are connected to one another in series. The wirings 33 are connected to electrical contacts 331 by means of outer conductive tracks 332.

Figure 4:
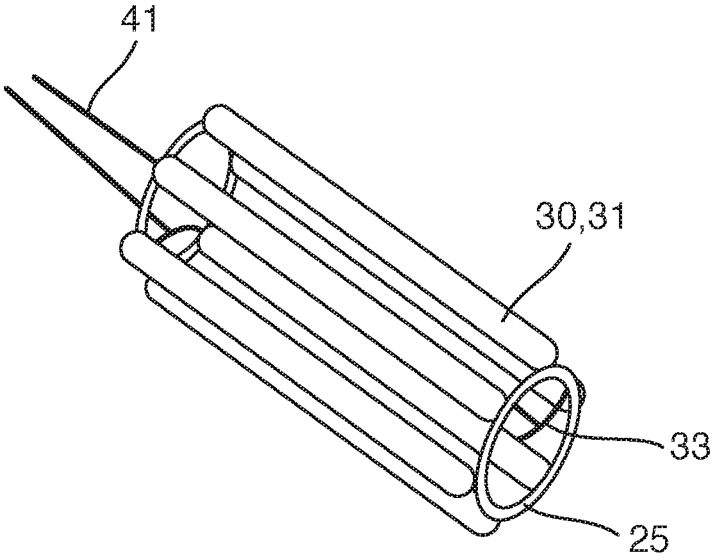

A further exemplary embodiment of a light fixture 10 of a LED lamp 100 described here is explained in greater detail with reference to the representation in FIG. 4. In this case a holder for the light-emitting diodes 31 of the light fixture 10 according to FIGS. 1 and 2 are illustrated in detail. The light-emitting diodes 31 are part of LED filaments 30 which are arranged on an outer lateral surface of a cylindrical glass support 25. The LED filaments 30 are electrically conductively connected to one another by means of wiring 33. This facilitates common contacting of the LED filaments 30 to the inner connection regions 41.

An exemplary embodiment of an LED lamp 100 described here is explained in greater detail with reference to the representation in FIG. 5. The LED lamp 100 is an LED retrofit lamp. The LED lamp 100 comprises a glass shell 60, a socket 61, a mounting base 62 and a light fixture 10. The socket can be an E27 or an E14 socket. The glass shell 60 is connected by means of the mounting base 62 to the socket 61.

Figure 5:
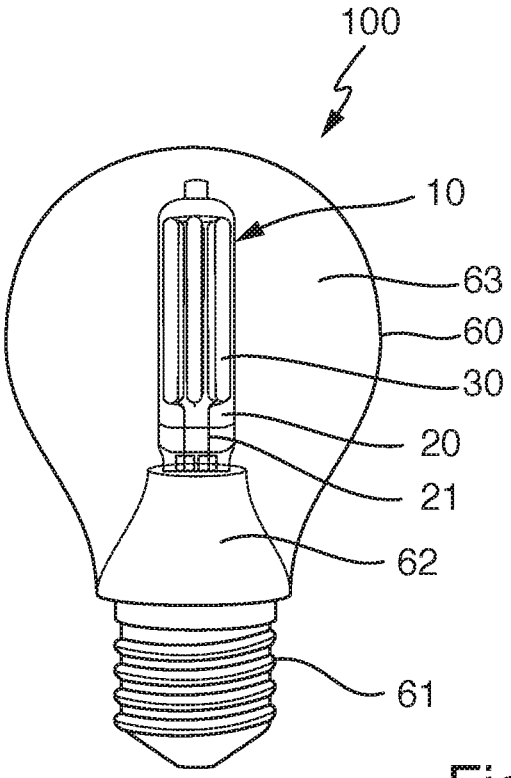

In the exemplary embodiment of FIG. 5, the light fixture 10 is constructed with LED filaments 30. The light fixture 10 is inserted into the mounting base 62 by the mounting region 21. The connectors 40, 41, 42 (not shown in FIG. 5) are electrically conductively connected to the socket 61 by the mounting base 62. The light fixture 10 is surrounded by the glass shell 60.

A heat-conducting gas is located in the intermediate space 63 between the glass shell 60 and the light fixture 10, wherein the pressure of the heat-conducting gas in the intermediate space 63 is lower than in the glass bulb 20 of the light fixture 10. In order to maintain the pressure in the glass shell 60, the glass shell is preferably vacuum sealed.

Figure 6:
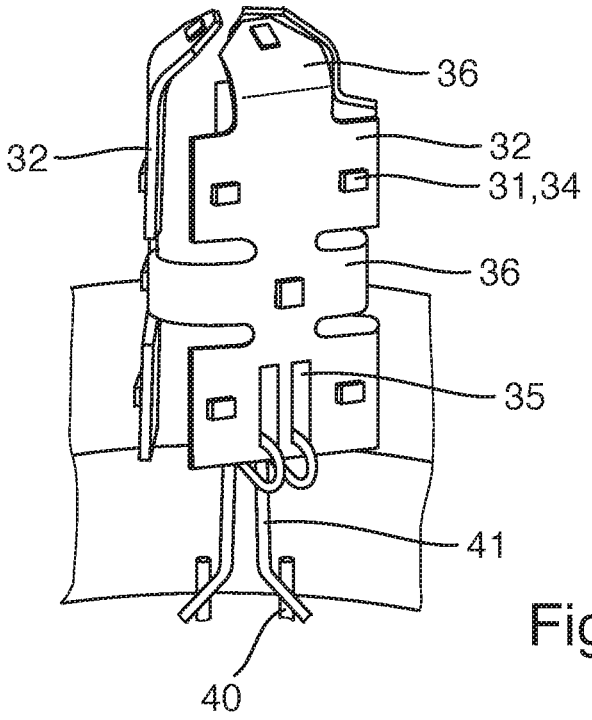

A further exemplary embodiment of a light fixture 10 of a LED lamp 100 described here is explained in greater detail with reference to the representation in FIG. 6. This shows a circuit board 32 with light-emitting diodes 31 which are provided for arrangement in the interior space of the light fixture 10. The circuit board 32 comprises holders 36 which serve for mechanical and/or electrical connection to further circuit boards 32. In this way several circuit boards 32 can be arranged relative to one another and a large solid angle can be covered by the light-emitting diodes 31. As an example, in FIG. 6 three circuit boards 32 are illustrated which are arranged on the lateral surfaces of a straight prism with a base surface of an equilateral triangle. However, arrangements of more circuit boards 32 are also conceivable, wherein the holders 36 are in each case bent corresponding to the required angle between the circuit boards 32. In the exemplary embodiment according to FIG. 6 the angle between the circuit boards 32 is 60° within the range of production tolerance.

One of the circuit boards 32 has contact regions 35 which are connected to the inner connection regions 41 and the fusion region 40. The light-emitting diodes 31 of the other circuit boards 32 can be contacted by means of the holders 36.

Figure 7:
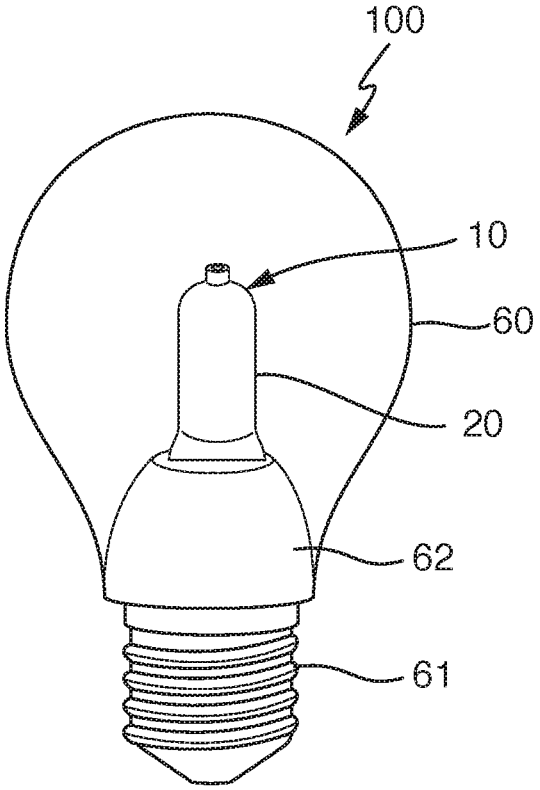

An exemplary embodiment of an LED lamp 100 described here is explained in greater detail with reference to the representation in FIG. 7. In contrast to the LED lamp according to FIG. 5 the illustrated LED lamp 100 contains a light fixture 10 with a matte glass bulb 20. Due to the matting of the glass bulb 20 the light-emitting diodes 31 in the glass bulb 20 can be concealed and an aesthetic visual appearance of the LED lamp 100 can be improved. In particular, in the case of a light-emitting diode 31 attached to a circuit board 32, the glass bulb 20 can be matte since wiring on the circuit board 32 can be concealed thereby.

Different embodiments of light-emitting diodes 31 for a light fixture 10 described here are explained in greater detail with reference to the schematic illustrations in FIGS. 8, 9A and 9B.

Figure 8:
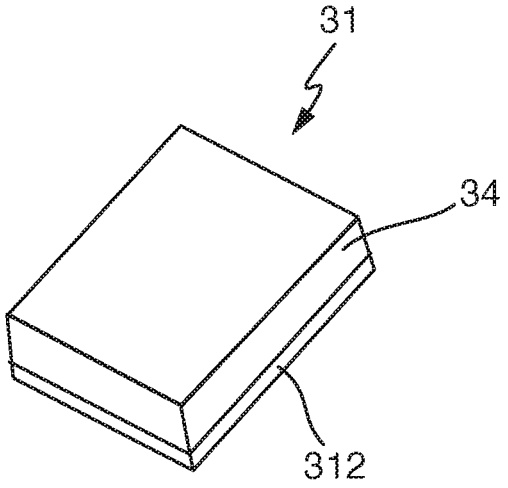

The light-emitting diode 31 according to FIG. 8 is constructed as a volume emitter. The light-emitting diode 31 can contain a substrate 312 which is, in particular, transparent to radiation and on which the radiation-emitting semiconductor layers of the light-emitting diode 31 are placed. The semiconductor layers can be covered with a conversion material 34 constructed as a fluorescent layer.

Figure 9A:
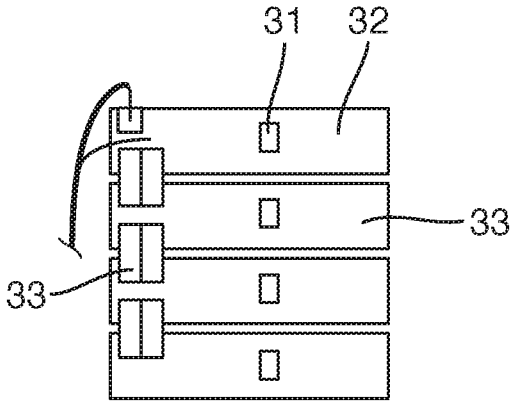
Figure 9B:
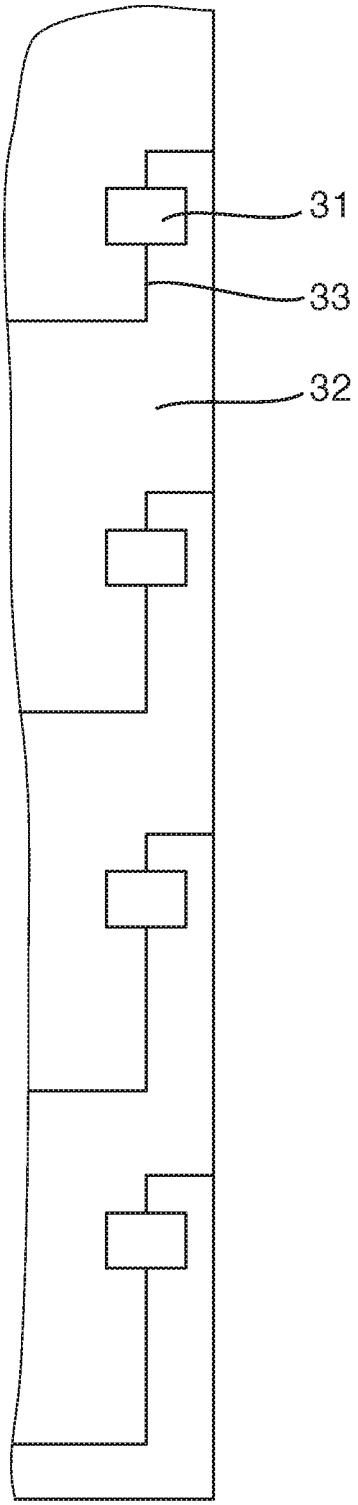

In FIGS. 9A and 9B the light-emitting diodes 31 are in each case mounted on a circuit board 32, wherein the light-emitting diodes 31 can be connected to one another by means of wiring 33. In the exemplary embodiment according to FIG. 9A, a light-emitting diode 31 is uniquely associated with each circuit board 32. The wirings 33 are constructed as metal platings which are fitted in connection regions of the circuit boards 32. The number of required light-emitting diodes 31 is easily scalable in this embodiment, since in each case only individual circuit boards 32 have to be added or removed and it is not necessary for the entire wiring and/or circuit board size to be redesigned.

In the exemplary embodiment according to FIG. 9B several light-emitting diodes 31 are mounted on one single circuit board 32. The wirings 33 are constructed as conductive tracks on the circuit board 32. An advantage of this embodiment, in particular, is that many light-emitting diodes 31 are provided on a small space.

Figure 10A:
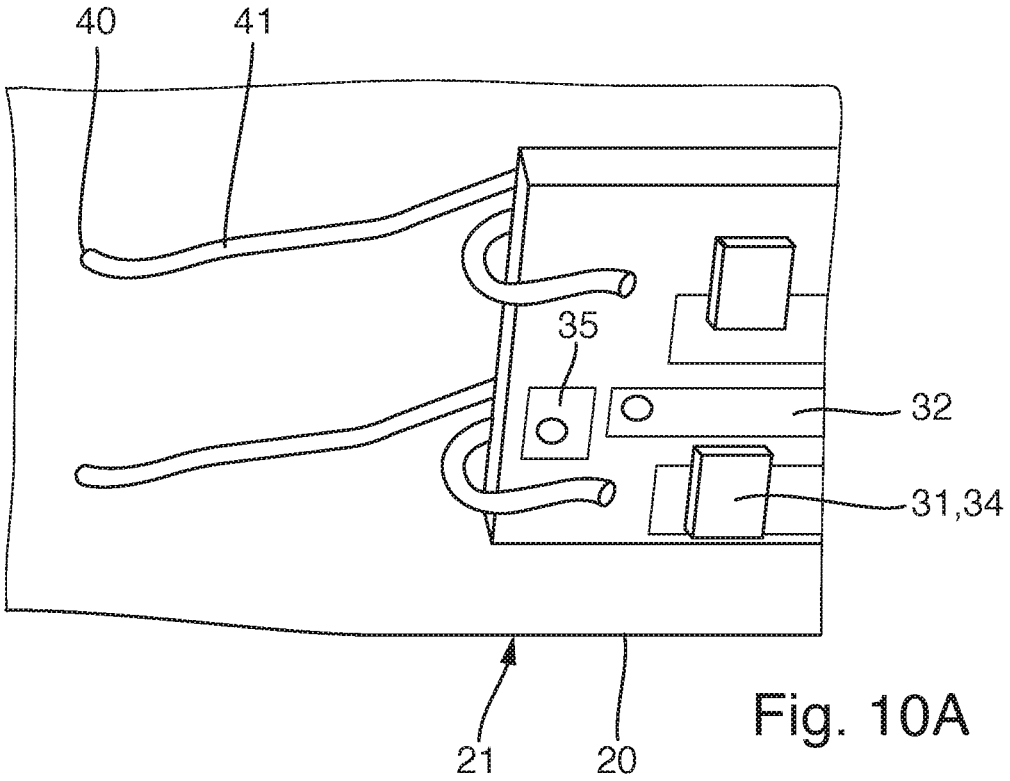
Figure 10B:
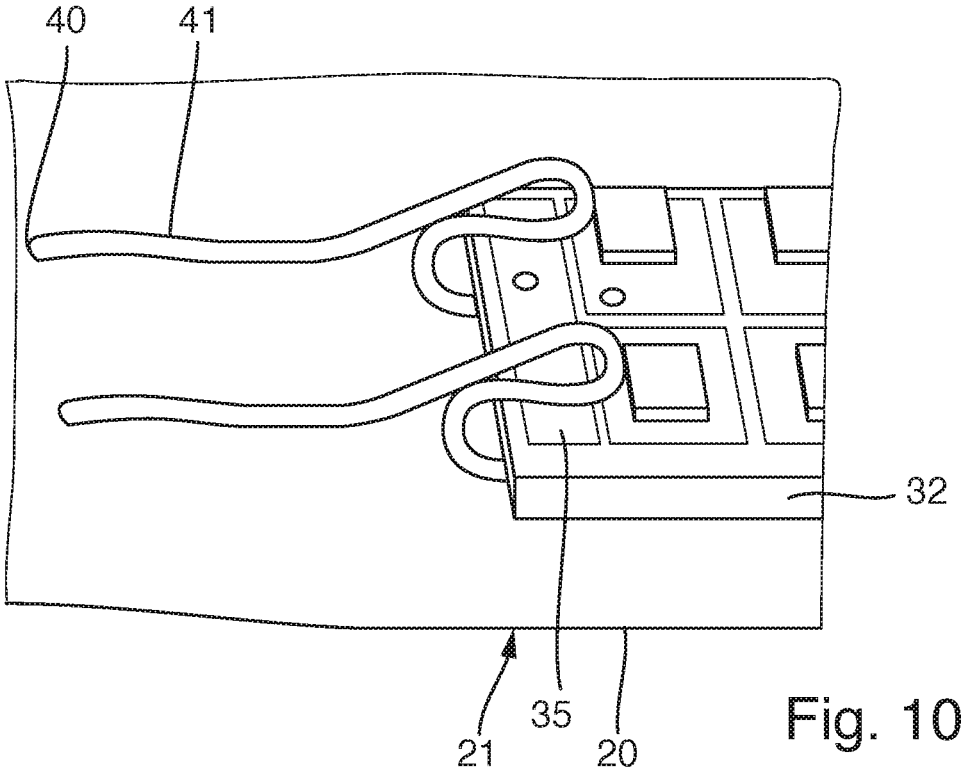

The fusion of the glass bulb 20 of a light fixture 10 described here with the connectors 40, 41, 42 of the light fixture 10 is explained in greater detail with reference to the illustrations in FIGS. 10A and 10B. In this case FIG. 10A shows a front view of a part of the light fixture 10 and FIG. 10B shows a rear view. It shows the inner connection regions 41 and the fusion regions 40 of the connectors. Purely by way of example the light-emitting diodes 31 of the light fixture 10 are mounted on a circuit board 32.

The connectors 40, 41, 42 include a wire which extends outwards from an interior space of the glass bulb 20. In the fusion region 40 the glass material of the glass bulb 20 in the molten state has been squeezed or compressed, so that the wire is completely surrounded by glass and thus is melted into the glass. This enables airtight sealing of the glass bulb 20. A film for fusion with the glass material of the glass bulb 20 can also be mounted between the wire and/or instead of the wire in the fusion region 40.

The wire can be made from not only molybdenum or tungsten but also a getter material such as for example tantalum. Typically, however, molybdenum is used and can be coated with a getter material (for example ZrAl).

The wire can be bent double in the first connection region 41. As a result, it is possible for a contact region 35 on the front side and on the rear side of the circuit board 32 to be electrically conductively connected to the wire. In other words, the first connection region 41 can be in direct contact with a front side and a rear side of the circuit board 32. A better electrical power supply is guaranteed by such a contact. Moreover, due to this solution purely by clamping it is possible to dispense with soldering. Moreover, the light-emitting diodes 31 can be contacted more or less concurrently on the front side and on the rear side. Thus, in the event of a defect of one of the light-emitting diodes 31 on the front side or on the rear side the side without the defect can continue to light.

Figure 11A:
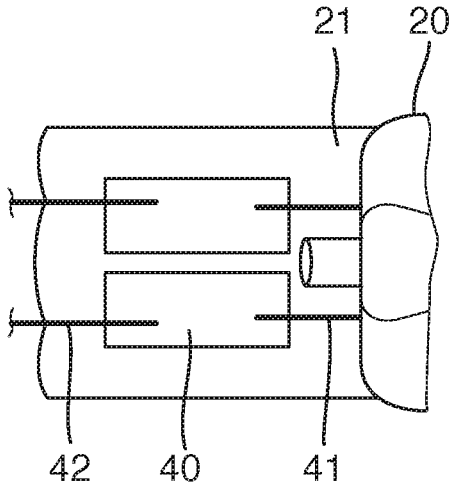
Figure 11B:
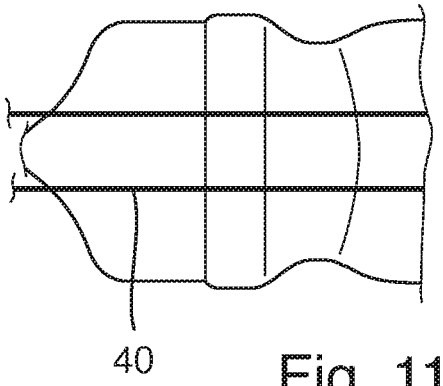
Figure 12A:
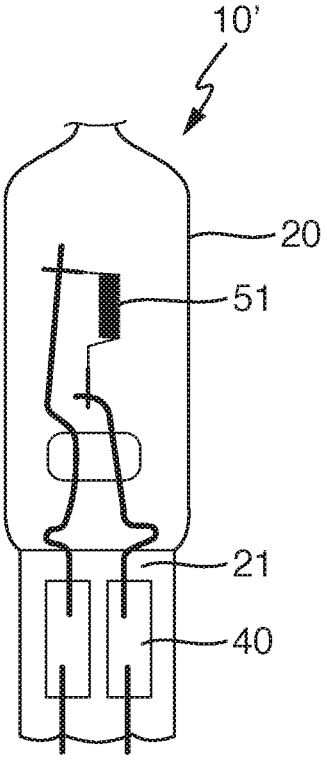
Figure 12B:
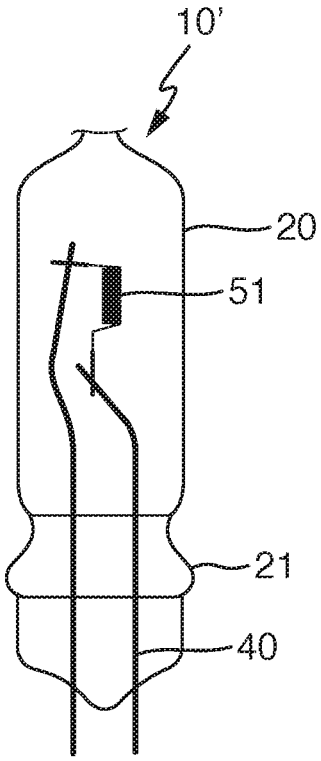
Figure 13A:
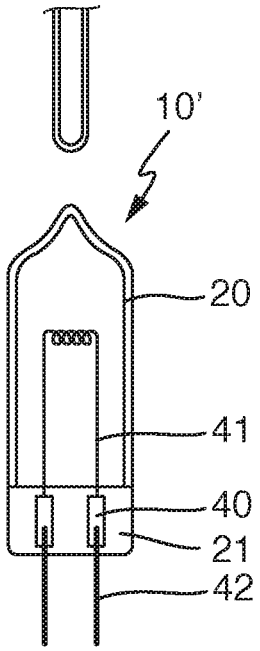
Figure 13B:
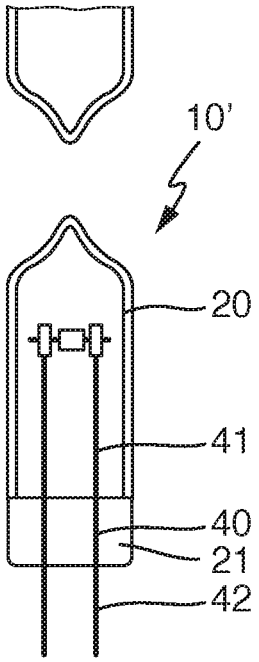

The fusion of the glass bulb 20 of a light fixture 10 described here with the connectors 40, 41, 42 of the light fixture 10 is explained in greater detail with reference to the illustrations in FIGS. 11A, 11B, 12A, 12B, 13A and 13B. FIGS. 11A, 12A and 13A in each case show fusion when quartz glass is used as material for the glass bulb 20. FIGS. 11B, 12B and 13B in each case show fusion when tempered glass, such as for example borosilicate glass, aluminosilicate glass and/or Duran glass, is used as material for the glass bulb 20. In this case present FIGS. 12A, 12B, 13A and 13B in each case show alternative light fixtures 10', which differ from the light fixtures 10 described here in that instead of light-emitting diodes 31 a glow wire 51 is used as luminaire. However, in the light fixture 10 described here the fusion in the region of the mounting region 21 or fusion region 40 corresponds to that of the alternative light fixture 10'. Thus, the features of the fusion region 40 described in connection with the alternative light fixtures 10' should be regarded explicitly as exemplary embodiments belonging to the invention.

In the case of quartz glass lamps the fusion region 40 contains a film which in particular can be a molybdenum film. In contrast to this, in the case of tempered glass lamps the wire current supplies of the connectors 40, 41, 42 are directly melt-connected. In the case of tempered glass lamps the wire in the connection region 40 can likewise be formed with molybdenum. Alternatively, a wire with an iron-nickel-cobalt alloy and/or a tungsten wire can be used.

Generally molybdenum-glass compounds are only possible as wire melt connection if the coefficients of thermal expansion differ by less than approximately 10%, for example in the case of tempered glasses. For example, quartz glass has a coefficient of thermal expansion of $0.6*10^{-6}$ $K^{-1}$, molybdenum has a coefficient of thermal expansion of $5.1*10^{-6}$ $K^{-1}$ and tempered glass has a coefficient of thermal expansion of $4.7*10^{-6}$ $K^{-1}$. By the use of a molybdenum film and/or transition glasses in the fusion region 40 the difference in the coefficients of thermal expansion can be compensated for and a melt splice can be provided between the connectors 40, 41, 42 and the glass bulb 20.

Figure 14A:
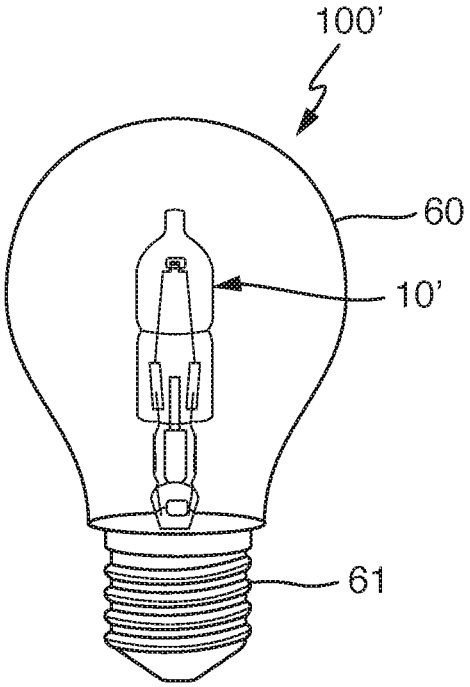
Figure 14B:
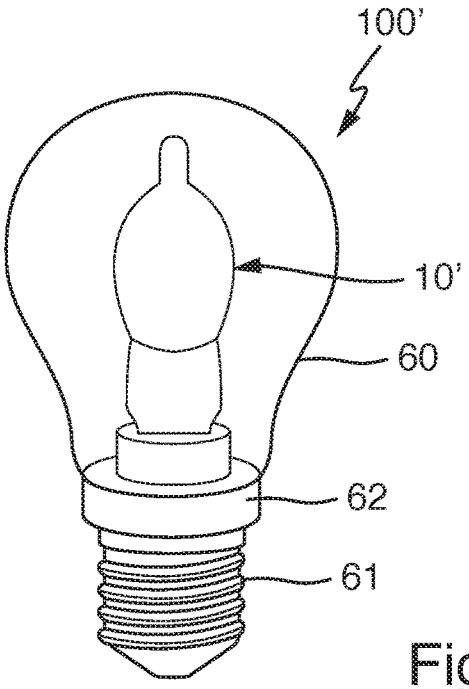
Figure 14C:
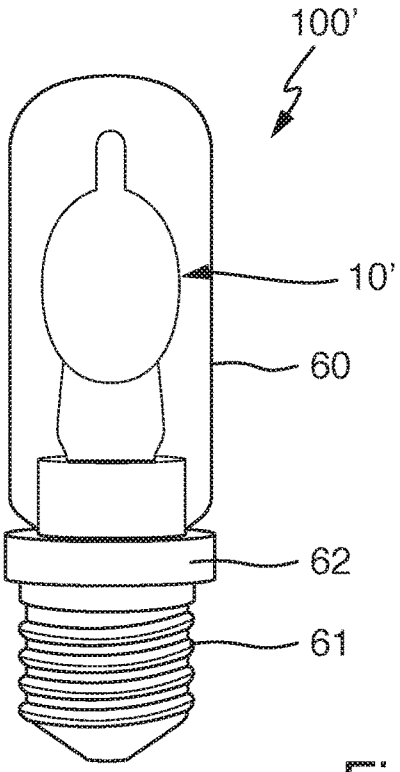

Exemplary embodiments of a light fixture 10 described here, as well as LED lamps 100 described here, are explained in greater detail with reference to the illustrations in FIGS. 14A, 14B and 14C. The drawings in each case show alternative lamps 100' with alternative light fixtures 10', in which instead of light-emitting diodes 31 a glow wire is used as luminaire. However, the other components of the alternative lamps 100' correspond to those of the LED lamps 100 described here. In other words, it is merely necessary to replace the glow wires with light-emitting diodes 31 in order to provide an LED lamp 100 described here. Thus, the features described in connection with the alternative lamps 100' should be regarded explicitly as exemplary embodiments belonging to the invention.

The alternate lamps 100' in each case comprise a glass shell 60, an alternative light fixture 10' as well as a socket 61. Furthermore, a mounting base 62 can be provided. The glass shell 60 can be pear-shaped (FIGS. 14A and 14B). Alternatively, the glass shell 60 can be cylindrical (FIG. 14C). The light fixture 10' can be constructed in the manner of a halogen lamp with a pin base (FIG. 14A). However, the glass bulb 20 can also be elliptical or ellipsoidal or spherical (FIGS. 14B and 14C). The advantage of such a shape lies in the greater volume in the glass bulb 20, so that the convection inside the glass bulb 20 is further improved.

Figure 15A:
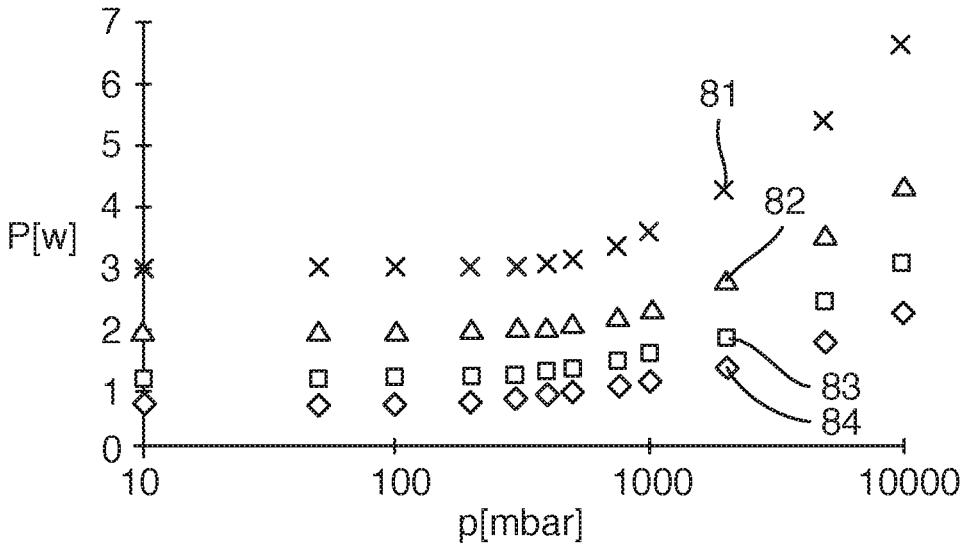
FIGS. 15A and 15B show measurement curves for explanation of a light fixture described here and an LED lamp described here.

A mode of operation of a light fixture 10 described here or of the LED lamp 100 described here is explained in greater detail with reference to the diagrams in FIGS. 15A and 15B. FIG. 15A shows a thermal output P in Watts from a luminaire arranged in the glass bulb 20 as a function of the pressure of the heat-conducting gas p (in mbar) in the glass bulb 20. In this case four different measurement curves for different heat-conducting gases are shown: nitrogen 81, argon 82, krypton 83 and xenon 84. As the filling pressure increases so also does the heat dissipation by the heat-removing gas.

Figure 15B:
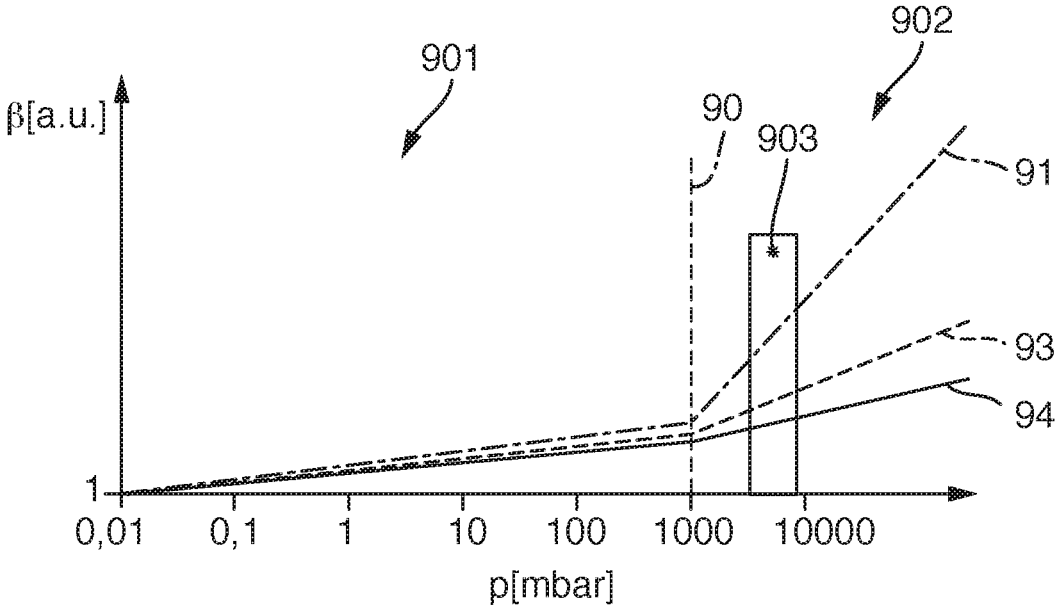

FIG. 15B shows a filling gas loss β in arbitrary units as a function of the pressure in the glass bulb 20 for helium 91, krypton 93 and xenon 94. In a first pressure range 901 below a bend point 90 at approximately 1000 mbar the pressure in the glass bulb 20 is so low that only gas diffusion is observed and no convection. In a second pressure range 902 above the bend point 90 the luminaire in the glass bulb 20 is cooled by means of convection. The third pressure range 903 corresponds to the filling pressure range of conventional halogen lamps and preferably the pressure range of the heat-conducting gas in the glass bulb 20 of a light fixture 10 described here.

The present application claims the priority of DE 10 2016 122 228.3, the disclosure of which is incorporated completely herein by reference.

The invention is not limited to these embodiments by the description with reference to the exemplary embodiments. On the contrary, the invention encompasses each new feature as well as any combination of features, in particular including any combination of features in the claims, even if this feature or this combination itself is not explicitly given in the claims or the exemplary embodiments.

LIST OF REFERENCES

10 light fixture
20 glass bulb
21 mounting region
22 extension
25 glass support
26 first housing
27 second housing
30 LED filament
31 light-emitting diode
32 circuit board
33 wiring
331 electrical contacts
332 conductive track
34 conversion material
35 contact region
36 holder
40 fusion region
41 inner connection region
42 outer connection region
51 glow wire
60 glass shell
61 socket
62 mounting base

63 intermediate space
81 thermal output for nitrogen
82 thermal output for argon
83 thermal output for krypton
84 thermal output for xenon
90 bend point
91 filling gas loss for helium
93 filling gas loss for krypton
94 filling gas loss for xenon
901 first pressure range
902 second pressure range
903 third pressure range
100 LED lamp

The invention claimed is:

1. A light fixture configured to be arranged inside a light-emitting diode (LED) lamp, the light fixture comprising:

a glass bulb filled with a heat-conducting gas having a higher thermal conductivity than air and a pressure of at least 2.2 bar at room temperature, wherein the glass bulb is vacuum-sealed by a press or pinch seal such that the heat-conducting gas cannot escape therefrom;

at least one light-emitting diode (LED) arranged inside the glass bulb; and at least one electrical connector that extends through the glass bulb from inside to outside the glass bulb such that the at least one LED inside the glass bulb is electrically connectable with the LED lamp outside the glass bulb.

2. The light fixture according to claim 1, wherein the glass bulb contains a gaseous getter material selected from the group consisting of oxygen, a silane, and a combination of oxygen and a silane.

3. The light fixture according to claim 1, wherein the glass bulb contains a solid getter material provided as at least one of a coating and a sintering material inside the glass bulb.

4. The light fixture according to claim 1, wherein the heat-conducting gas includes at least one of helium and hydrogen.

5. The light fixture according to claim 1, further comprising a circuit board inside the glass bulb, wherein the at least one light-emitting diode is arranged on the circuit board.

6. The light fixture according to claim 1, further comprising a plurality of circuit boards inside the glass bulb, wherein the at least one light-emitting diode is arranged on each circuit board.

7. The light fixture according to claim 6, wherein the plurality of circuit boards includes at least three circuit boards, and wherein the plurality of circuit boards are arranged on the lateral surfaces of an imaginary straight prism having an equilateral base surface.

8. The light fixture according to claim 1, wherein the at least one light-emitting diode is at least partially embedded in a conversion material.

9. The light fixture according to claim 1, further comprising a glass support inside the glass bulb, wherein the at least one light-emitting diode is arranged on the glass support between the glass support and the glass bulb.

10. The light fixture according to claim 9, wherein the glass support has the shape of a tube, wherein the at least one light-emitting diode is arranged on an outer lateral surface of the glass support.

11. The light fixture according to claim 1, further comprising at least one LED filament arranged inside the glass bulb, wherein the at least one light-emitting diode comprises a plurality of light-emitting diodes arranged on the at least one LED filament.

12. The light fixture according to claim 9, further comprising a plurality of LED filaments regularly spaced-apart on an outer lateral surface of the glass support, wherein a main extension direction of each LED filament extends along an extension direction of the glass support.

13. A light-emitting diode (LED) lamp comprising:

a glass shell filled with a first heat-conducting gas having a higher thermal conductivity than air and a pressure of at least 1 bar at room temperature; and a light fixture arranged inside the glass shell and comprising:

a glass bulb filled with a second heat-conducting gas having a higher thermal conductivity than air and a pressure of at least 2.2 bar at room temperature, wherein the glass bulb is vacuum-sealed by a press or pinch seal such that the second heat-conducting gas cannot escape therefrom;

at least one light-emitting diode (LED) arranged inside the glass bulb; and at least one electrical connector that extends through the glass bulb from inside to outside the glass bulb such that the at least one LED inside the glass bulb is electrically connectable with the LED lamp outside the glass bulb;

wherein the pressure of the first heat-conducting gas is at least 0.5 bar lower than the pressure of the second heat-conducting gas at room temperature.

14. The LED lamp according to claim 13, wherein the pressure of the first heat-conducting gas is at least 1 bar lower than the pressure of the second heat-conducting gas at room temperature.

15. The light fixture according to claim 1, wherein the heat-conducting gas in the glass bulb has a pressure of at least 5.1 bar at room temperature.

16. The light fixture according to claim 1, wherein the heat-conducting gas in the glass bulb has a pressure greater than 5.1 bar but at most 10 bar at room temperature.

17. The light fixture according to claim 1, wherein the glass bulb contains a solid getter material provided as a mass of either a pure metal or an alloy inside the glass bulb.

18. The light fixture according to claim 1, wherein the at least one electrical connector is configured to be electrically connectable with the LED lamp via a solder connection inside the LED lamp.

19. The light fixture according to claim 1, wherein the at least one electrical connector is configured to be electrically connectable with the LED lamp via a pin connection inside the LED lamp.

20. The light fixture according to claim 19, wherein the pin connection is provided as a G4 or a G9 pin connection.

21. The light fixture according to claim 1, wherein the at least one LED is of a chip-on-board (COB) configuration.

22. The light fixture according to claim 1, wherein the getter material comprises a solid getter material comprising at least one of zirconium (Zr) and an alloy of zirconium.

23. The LED lamp according to claim 13, wherein the first heat-conducting gas has a pressure of 1 bar at room temperature.

* * * * *